US007828291B2

(12) United States Patent
Enamito et al.

(10) Patent No.: US 7,828,291 B2
(45) Date of Patent: Nov. 9, 2010

(54) MECHANISM FOR CONVEYING SHEET

(75) Inventors: Akihiko Enamito, Kawasaki (JP); Takahiro Hiruma, Tokyo (JP); Masaki Takahashi, Yokohama (JP); Misato Ishikawa, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 221 days.

(21) Appl. No.: 12/233,740

(22) Filed: Sep. 19, 2008

(65) Prior Publication Data

US 2009/0085283 A1 Apr. 2, 2009

(30) Foreign Application Priority Data

Sep. 26, 2007 (JP) ..... 2007-249511

(51) Int. Cl.
*B65H 5/00* (2006.01)

(52) U.S. Cl. ..... 271/264; 271/272; 399/91

(58) Field of Classification Search ..... 271/264, 271/272, 242; 399/91
See application file for complete search history.

(56) References Cited

U.S. PATENT DOCUMENTS

2009/0026691 A1 * 1/2009 Ishikawa et al. ..... 271/10.12
2009/0028598 A1 * 1/2009 Moro et al. ..... 399/91

FOREIGN PATENT DOCUMENTS

JP 2000-77858 3/2000

* cited by examiner

*Primary Examiner*—Richard W Ridley
*Assistant Examiner*—Jeremy Severson
(74) *Attorney, Agent, or Firm*—Ohlandt, Greeley, Ruggiero & Perle, L.L.P.

(57) ABSTRACT

In a sheet conveying mechanism, a first bulging space and a second bulging space are provided on a downstream side and an upstream side, respectively, of a conveying path. The second bulging space has a length L1 along the conveying path. The conveying path between the first and second bunging spaces is defined to have a length L2. The lengths L1 and L2 are set to satisfy a predetermined relationship with a frequency of noise propagating through the conveying path. The sheet conveying mechanism can inexpensively reduce noise generated inside the conveying path during sheet conveyance without hindering the conveyance of the sheet.

12 Claims, 13 Drawing Sheets

---------- Compressing effect

——— Compressing and bulging effect

Optimum condition n-1, m=2 ⇒ $L_2=4L_1$ $$L_2=\frac{2m}{2n-1}L_1 \quad (n=1,2,\cdots)(m=1,2,\cdots)$$

$$f=\frac{(2n-1)c}{4L_1} \quad (n=1,2,\cdots)(m=1,2,\cdots)$$

MECHANISM FOR CONVEYING SHEET

CROSS-REFERENCE TO RELATED APPLICATIONS

This application is based upon and claims the benefit of priority from prior Japanese Patent Application No. 2007-249511, filed Sep. 26, 2007, the entire contents of which are incorporated herein by reference.

BACKGROUND OF THE INVENTION

1. Field of the Invention

The present invention relates to a mechanism that conveys sheets using a roller or a guide.

2. Description of the Related Art

Image forming apparatuses such as MFPs (Multifunction Peripherals) and sheet conveying mechanisms are improved so as to reduce possible noise. Most of the improvements for reducing possible noise are collision sound or flopping sound preventing measures for preventing a possible collision sound generated when a guide collides against a sheet or sound insulating or absorbing mechanisms that block gaps through which sound leaks. However, these measures require an additional material typified by a sound absorbing material, which requires new costs. In spite of the capability of reducing the collision sound, the measures for collision prevention and the like may degrade conveying performance if the method of the measure is inappropriate. A known method for reducing costs with the appropriate conveying performance maintained is Helmholtz resonance (intra-cavity resonance at a particular frequency) utilizing sound interference and typified by Japanese Patent No. 3816678. Specifically, this method provides a resonance space and makes a hole in the resonance space so that sound can be transmitted through the hole, to reduce a prevailing periodic sound. The method is effective on discrete periodic sounds (one frequency prevails significantly) resulting from rotation, such as an electromagnetic sound from a motor or a whirling sound from a fan. However, a sheet conveying noise made up of a plurality of noises such as a roller rotation sound, a paper rubbing sound, and a fan disturbance noise is not limited to the periodic sound but is distributed over a wide band. Thus, the application of the measure disclosed in Japanese Patent No. 3816678 is not expected to reduce the possible noise over a wide band.

Most of the improvements for reducing possible noise in the sheet conveying mechanism are sheet collision and flopping sound preventing measures using a guide or sound insulating or absorbing mechanisms that block gaps. However, these measures require new costs typified by a sound absorbing material, and may degrade the conveying performance depending on the method of the measure. Shape improving measures utilizing Helmholtz resonance improve the shape of the apparatus while avoiding degradation of the conveying performance and increasing the costs. The shape improving measures are effective on the discrete periodic sound but have difficulty reducing possible noise over a wide band. Thus, measures are required which improve the shape of the apparatus while avoiding the use of a new material such as a sound absorbing material, to reduce the costs and which reduce possible noise distributed over a wide band in addition to the periodic sound.

Furthermore, as is well known, when a bulging space is present in the conveying path, noise passing through the space tends to become louder. The bulging space is often provided in the conveying path because the space is required not only to reduce possible noise but also to assist the conveyance of sheets. In connection with the maintenance of the appropriate conveying performance, the bulging space cannot be simply closed. Thus, measures are also required which improve the conveying path to inhibit an increase in the level of noise in the bunging space.

As described above, most of the noise reducing means in the sheet conveying mechanism is the sheet collision and flopping sound preventing measures using the guide or the sound insulating or absorbing mechanisms that block the gaps. However, these measures require new costs typified by the sound absorbing material, and may degrade the conveying performance depending on the method of the measure. The shape improving measures utilizing the Helmholtz resonance improve the shape of the apparatus while avoiding degradation of the conveying performance and increasing the costs. The shape improving measures are effective on the discrete periodic sound but have difficulty reducing the possible noise over a wide band. Thus, the measures are required which improve the shape of the apparatus while avoiding the use of the new material such as the sound absorbing material, to reduce the costs and which reduce the possible noise distributed over a wide band in addition to the periodic sound.

Furthermore, as is well known, when the bulging space is present in the conveying path, the noise passing through the space tends to become louder. For purposes including a reduction in possible noise, the bulging space is often provided in the conveying path. The bulging space cannot be simply closed. Thus, the measures are also required which improve the conveying path to inhibit an increase in the level of noise in the bunging space.

BRIEF SUMMARY OF THE INVENTION

One aspect of the present invention provides a sheet conveying mechanism comprising:

a pair of conveying rollers which conveys a paper-like medium;

a conveying guide which guides the paper-like medium to the conveying rollers; and a conveying housing which defines a conveying path along which the paper-medium is conveyed, a first bulging space and a second bulging space being provided on a downstream side and an upstream side, respectively, of the conveying path, the second bulging space having a length L1 along the conveying path, the conveying path between the first and second bunging spaces being defined to have a length L2, the lengths L1 and L2 satisfying a relationship expressed by Formulas 1 and 2, $$L_2 = \frac{2m}{2n-1} L_1 \quad (n = 1, 2, \ldots)(m = 1, 2, \ldots) \tag{1}$$

$$f = \frac{(2n-1)c}{4L_1} \quad (n = 1, 2, \ldots) \tag{2}$$

wherein in Formulas 1 and 2, c denotes sound velocity, and f denotes a frequency of possible noise propagating through the conveying path and corresponds to a central frequency of a frequency band of noise to be attenuated in the conveying housing.

DETAILED DESCRIPTION OF THE INVENTION

A sheet conveying mechanism of an image forming apparatus according to an embodiment of the present invention will be described with reference to the drawings as required.

Figure 1:
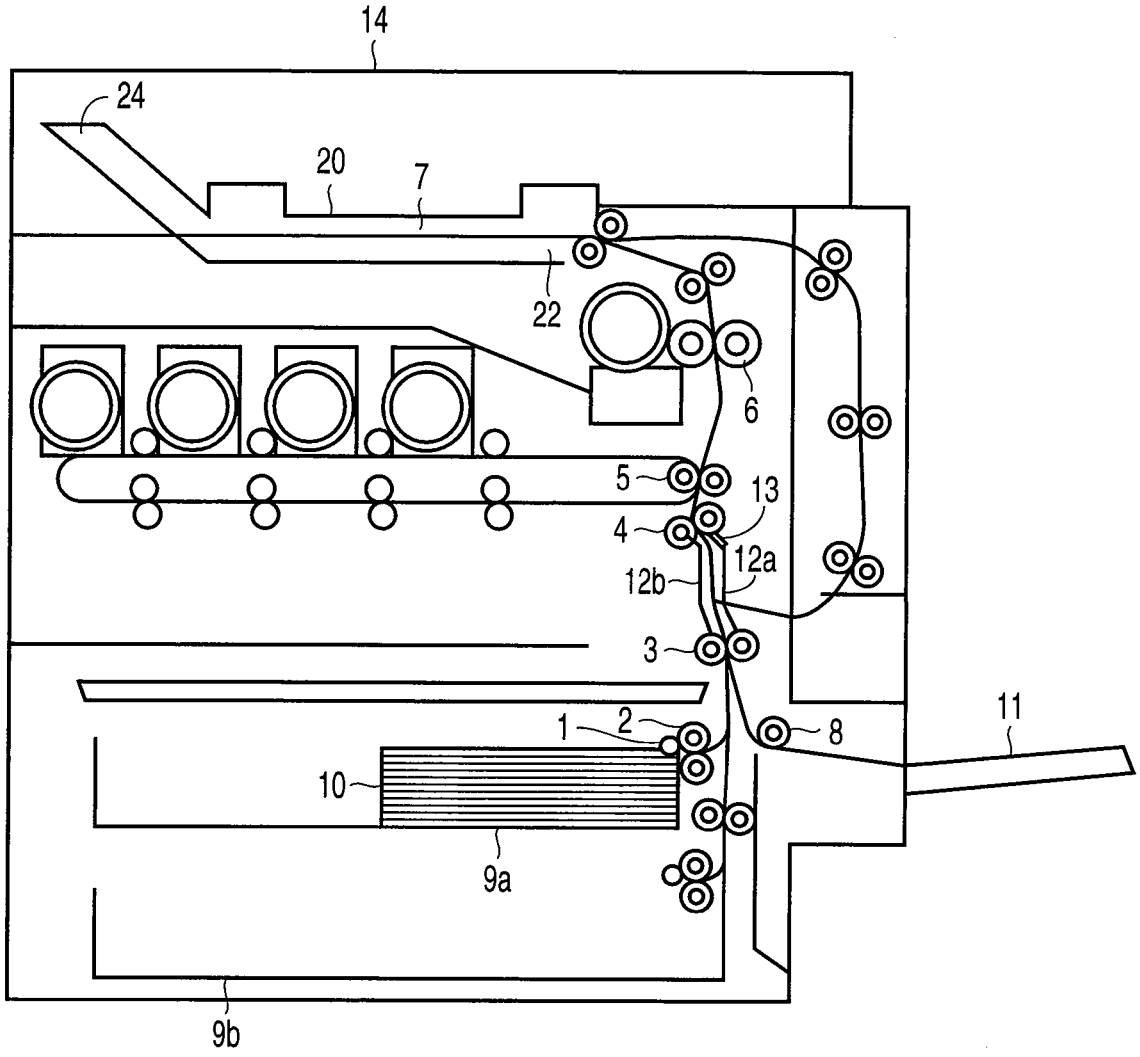
FIG. 1 is a schematic diagram showing the configuration of an image forming apparatus according to an embodiment of the present invention.

FIG. 1 is a schematic diagram showing the configuration of a sheet conveying part of an electro-photographic apparatus that is an image forming apparatus according to the present invention. A housing 14 shown in FIG. 1 has sheet feeding cassettes 9*a* and 9*b* that accommodate sheet-like members such as sheet metal or resin on which images are formed, or sheets 10 (which mean paper-like media; the simple term "sheets 10" includes paper-like media), and a hand tray 11 via which the sheets 10 are supplied. A pickup roller 1 picks up the sheet 10 from the sheet feeding cassettes 9*a* and 9*b*. A sheet feeding roller 2 conveys the sheet to a conveying path. The sheet 10 is picked up from the hand tray 11 and conveyed to the conveying path by a hand sheet feeding roller 8.

The picked-up sheet 10 is conveyed by an intermediate conveying roller pair 3 along conveying guides 12*a* and 12*b* defining a conveying path. The sheet 10 is guided to a registration roller pair 4 by a registration guide 13 and then fed to an image forming part 5. The image forming part 5 transfers an image formed in accordance with image data to the sheet 10. The image transferred to the sheet 10 is heated and pressurized by a fixing part 6 so that the image is fixed to the sheet 10. The sheet 10 is then conveyed to a sheet-discharging conveying part 7 that discharges the sheet 10 to the exterior of the conveying apparatus. The sheet conveying part 7 is formed of a flat box-like housing (duct) 20 comprising an introduction port 22 through which the sheet 10 is introduced and a sheet discharging port 24 through which the sheet 10 is discharged to the exterior of the apparatus. As is apparent from the description of embodiments, the housing 20 is formed such that noise generated in the apparatus or during conveyance of the sheet 10 is transmitted through the introduction port 22 of the housing 20 to the interior of the housing 20, where the noise is attenuated. Consequently, the noise transmitted to the interior of the housing 20 is inhibited from leaking to the exterior through the sheet discharging port 24 of the housing 20.

FIRST EMBODIMENT

Figure 2A:
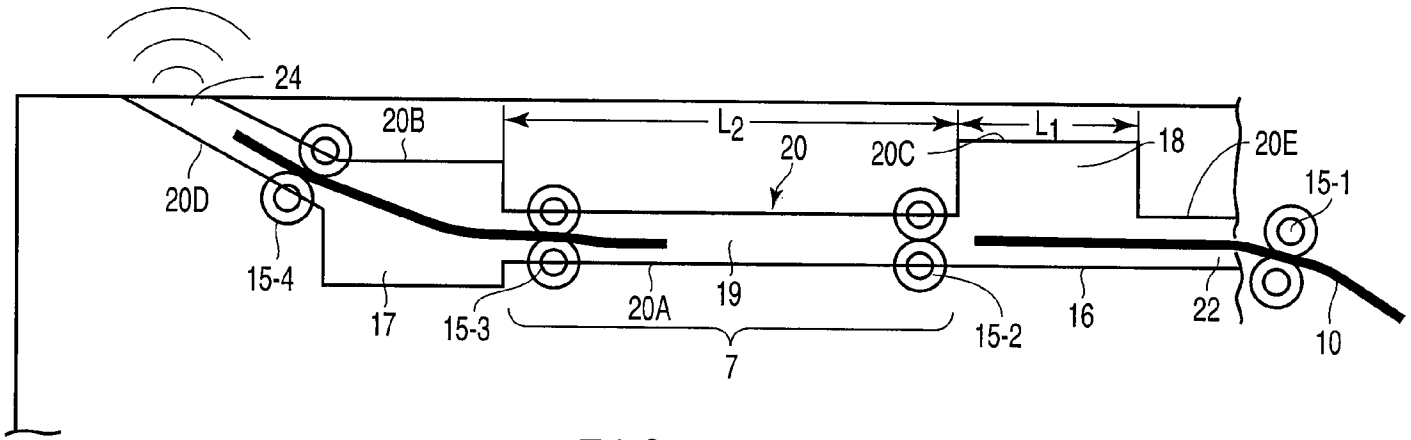
FIG. 2A is a schematic diagram schematically showing a sheet conveying apparatus illustrating a first embodiment of the present invention.
Figure 2B:
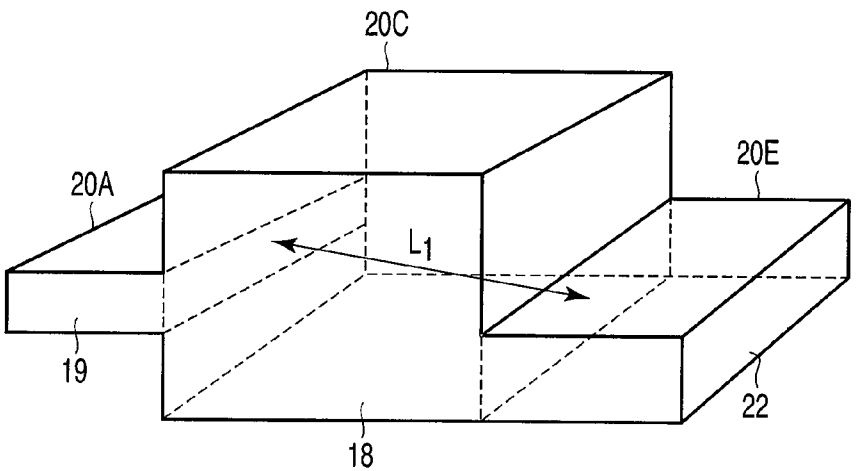
FIG. 2B is a perspective view schematically showing a bulging housing portion shown in FIG. 2A.

FIG. 2A shows a sheet conveying part of an image forming apparatus according to a first embodiment. As shown in FIG. 2A, the sheet conveying part 7 comprises conveying roller pairs 15-1 to 15-4 that convey the sheet 10 and a sheet conveying path 16 formed of a conveying guide that guides sheet-like members such as sheet metal or resin or the sheets 10. The housing 20, which defines the sheet conveying path 16, is composed of a rectangular, flat housing portion (duct part) 20A that defines a sheet conveying path 19 as a narrow space trough which the sheet 10 is conveyed, a bulging housing portion 20B provided downstream of the housing portion 20A, and a bulging housing portion 20C provided upstream of the housing portion 20A as shown in FIG. 2B. In the housing 20, a rectangular, flat housing portion 20D similar to the housing portion 20A is formed between the bulging housing portion 20B and the sheet discharging port 24. A rectangular, flat housing portion 20E similar to the housing portion 22A is also formed between the bulging housing portion 20C and the introduction port 22. The sheet 10 is conveyed to the upstream side on which the introduction port 22 is provided or the downstream side on which the sheet discharging port 24 is provided.

The sheet 10 supplied to the sheet conveying path 16 via the introduction port 22 by the conveying roller pair 15-1 is conveyed via a rectangular, flat conveying path in the housing portion 20E to a conveying path 18 in the bulging housing portion 20C which has a rectangular bulging space extending like a protrusion. The sheet 10 is picked up from the conveying path 18 and conveyed to a rectangular flat conveying path 19 in the housing portion 20A by the conveying roller pair 15-2. The sheet 10 is then conveyed by the conveying roller pair 15-3 to a conveying path 17 in the housing portion 20B which has a rectangular bulging space extending like a protrusion. The sheet 10 is picked up from the conveying path 17 and then discharged through the sheet discharging port 24 via a rectangular, flat conveying path in the housing portion 20D, by means of the conveying roller pair 15-4.

As described above, if the bulging conveying path 17 is provided on the downstream side of the sheet conveying path, the conveying path 18 with a length L1 along a conveying direction is provided on the upstream side of the sheet conveying path. The sheet conveying path 19 with a length L2 along the conveying direction is provided between the two bulging conveying paths 17 and 18. If the conveying path lengths L1 and L2 satisfy the relationship expressed by Formula 1, the lengths L1 and L2 enable a reduction in possible noise propagating through the conveying path, around a frequency band expressed by Formula 2.

Figure 2C:
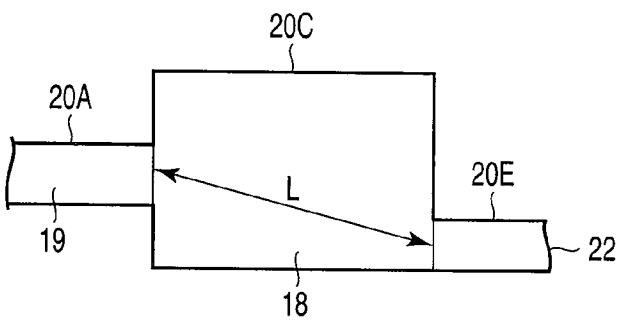
FIG. 2C is a sectional view schematically showing the bulging housing portion shown in FIG. 2A.

Here, as shown in FIGS. 2B and 2C, the length L1 denotes the length of the shortest route joining the center of a sheet entry-side conveying path cross part of the bulging conveying path 18 to the center of a discharge-side conveying path cross section of the bulging conveying path 18. The length L2 denotes the length of the shortest route joining the center of the discharge-side conveying cross section of the bulging conveying path 18 to the center of an entry-side conveying cross section of the bulging conveying path 17, located on the downstream side. Furthermore, c denotes sound velocity.

$$L_2 = \frac{2m}{2n-1} L_1 \quad (n = 1, 2, \ldots)(m = 1, 2, \ldots) \tag{1}$$

$$f = \frac{(2n-1)c}{4L_1} \quad (n = 1, 2, \ldots)(m = 1, 2, \ldots) \tag{2}$$

With the physical dimensions of the apparatus taken into account, the length L1 of the bulging conveying path 18 is 80 cm at a maximum and preferably less than 80 cm. Since the frequency of a paper rubbing sound or noise from a fan in the sheet conveying path is at most 1 kHz, the frequency f of possible noise to be inhibited is preferably set to 500 Hz to 1 kHz, corresponding to a frequency band that is disagreeable to the ear.

Now, the property of a sound transmitted through a common conveying path will be described with reference to FIGS. 3 to 6.

Figure 3:
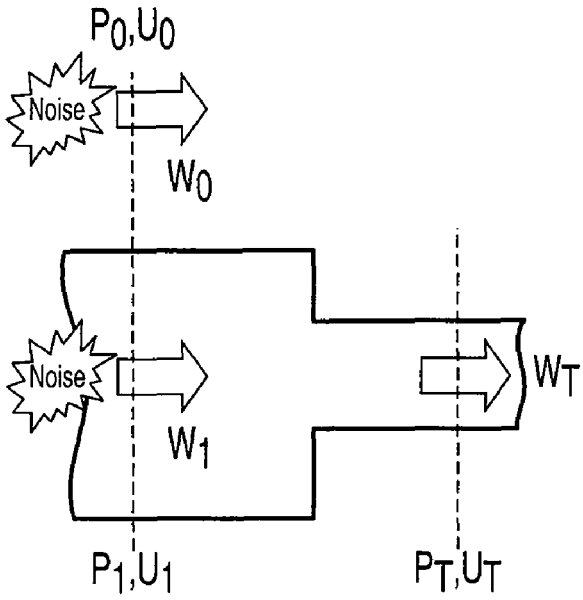
FIG. 3 is a schematic diagram illustrating the property of acoustic power propagation through a conveying path shown in FIG. 1.

As shown in FIG. 3, consider an acoustic power reduction effect exerted after passage through a bulging duct and a compressing duct when a sound source with a sound pressure P0, a particle velocity U0, and an acoustic power W0 is present in the conveying path.

The acoustic power observed after passage through a certain cross section T in the conveying path is defined as Wt. Then, the power reduction effect Att after the passage is as described below.

In formulas shown below, Z denotes a distance along the conveying path, and A, B, C, and D denote variables. Z0 and ZT denote acoustic impedances.

$$W_0 = \frac{1}{2}\mathrm{Re}[P_0 \cdot U_0^*] = \frac{1}{2}\mathrm{Re}[Z_0]|U_0|^2 \tag{3}$$

$$\because P_0 = Z_0 U_0$$

$$W_T = \frac{1}{2}\mathrm{Re}[P_T \cdot U_T^*] = \frac{1}{2}\mathrm{Re}[Z_T]|U_T|^2$$

$$\eta_{Att} = 10 \cdot \log\left(\frac{W_T}{W_0}\right) \tag{4}$$

$$= 10 \cdot \log\frac{\mathrm{Re}[Z_T]}{\mathrm{Re}[Z_0]} + 10 \cdot \log\frac{1}{|CZ_T + D|^2} + 10 \cdot \log\frac{|U_1|^2}{|U_0|^2}$$

$$= 10 \cdot \log\frac{1}{|CZ_T + D|^2} \tag{5}$$

$$\because \begin{pmatrix} P_1 \\ U_1 \end{pmatrix} = \begin{pmatrix} A & B \\ C & D \end{pmatrix}\begin{pmatrix} P_T \\ U_T \end{pmatrix}$$

$$U_T = \frac{U_1}{CZ_T + D} \quad \because P_T = Z_T U_T,\ Z_0 = Z_T \tag{6}$$

Here, the sound source provides mechanical noise and thus does not change whether the sound source is located outside or inside the duct. Thus, the particle velocity (vibration velocity) U0=U1, and the third item of Formula 4 is negligible.

Thus, an acoustic power that varies while traveling through the conveying path is expressed by Formula 7. This numerical value is negative and means that the amount of reduction increases consistently with the value.

$$\eta_{Att} = -20 \log|CZ_T + D(dB) \tag{7}$$

Figure 4:
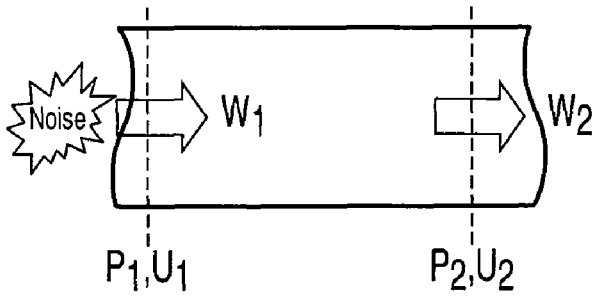
FIG. 4 is a schematic diagram illustrating the property of the acoustic power propagation through the conveying path shown in FIG. 1.

Here, within a frequency range expressed by Formula 8 and in which a plane wave (one-dimensional wave) propagates as shown in FIG. 4, the relationship between sound pressure P and volume velocity U is generally as expressed by Formula 9.

$$ff < \frac{c}{2d} \tag{8}$$

(c: Sound velocity d: Long side of duct)

$$\begin{pmatrix} P_1 \\ U_1 \end{pmatrix} = \begin{pmatrix} \cos kL_1 & j\frac{\rho c}{S_1}\sin kL_1 \\ j\frac{S_1}{\rho c}\sin kL_1 & \cos kL_1 \end{pmatrix} \begin{pmatrix} \cos kL_2 & j\frac{\rho c}{S_2}\sin kL_2 \\ j\frac{S_2}{\rho c}\sin kL_2 & \cos kL_2 \end{pmatrix}\begin{pmatrix} P_2 \\ U_2 \end{pmatrix} = \begin{pmatrix} A & B \\ C & D \end{pmatrix}\begin{pmatrix} P_2 \\ U_2 \end{pmatrix} \tag{9}$$

Consequently, C and C in Formula 7 can be expressed by Formula 10.

$$\therefore CZ_2 + D = j\left(\frac{S_1}{S_2}\sin kL_1 \cos kL_2 + \cos kL_1 \sin kL_2\right) - \frac{S_1}{S_2}\sin kL_1 \sin kL_2 + \cos kL_1 \cos kL_2 \quad \because Z_2 = \frac{\rho c}{S_2} \tag{10}$$

Figure 5A:
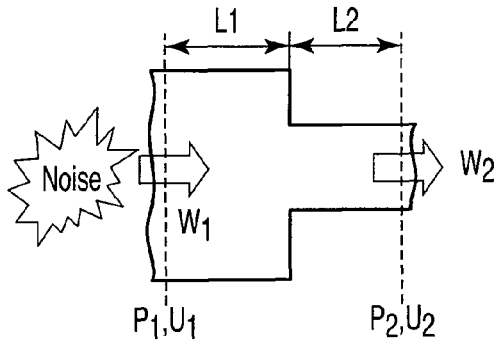
FIGS. 5A and 5B are schematic diagrams illustrating the property of the acoustic power propagation through the conveying path shown in FIG. 1.
Figure 5B:
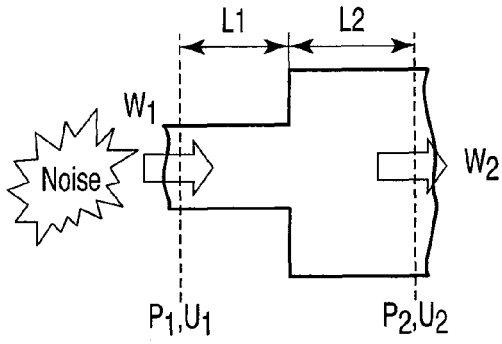

Thus, for a brief description of the principle, a brief description will be given of propagation through two spaces, that is, from a bulging space to a compressing space as shown in FIG. 5A and from the compressing space to the bulging space as shown in FIG. 5B. Approximate formulas are shown below.

With the compressing space, when S1>>S2, the propagation occurs as shown below.

Here, k is a constant, and S1 and S2 denote the sectional areas of the bulging space and narrow space in the conveying path. S1>>S2 means that the acoustic power is transmitted from the bulging space to the narrow space as shown in FIG. 5A.

$$CZ_2 + D \cong j\left(\frac{S_1}{S_2}\sin kL_1 \cos kL_2\right) - \frac{S_1}{S_2}\sin kL_1 \sin kL_2 \cong \frac{S_1}{S_2}\sin kL_1 (j\cos kL_2 - \sin kL_2) \tag{11}$$

$$\therefore \eta_{Att} = -20\log|CZ_2 + D| = -20\log\left(\frac{S_1}{S_2}\right) - 20\log|\sin kL_1| \tag{12}$$

With the bulging space, when S2>>S1, that is, when the acoustic power is transmitted from the narrow space to the bulging space as shown in FIG. 5B, the propagation occurs as follows.

$$CZ_2 + D \cong j(\cos kL_1 \sin kL_2) + \cos kL_1 \cos kL_2 \cong \cos kL_1 (j\sin kL_2 + \cos kL_2) \tag{13}$$

$$\therefore \eta_{Att} = -20\log|CZ_2 + D| = -20\log|\cos kL_1| \tag{14}$$

Figure 6:
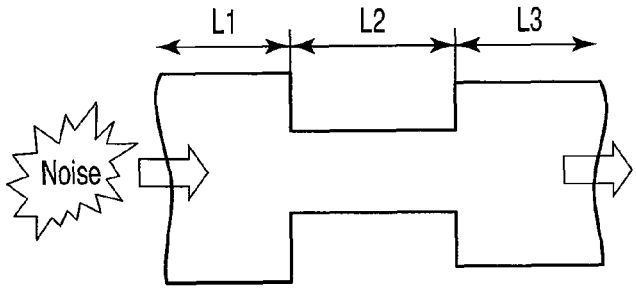
FIG. 6 is a schematic diagram illustrating the property of the acoustic power propagation through the conveying path shown in FIG. 1.

Thus, given the space in a conveying path shown in FIG. 6, the propagation occurs as follows in the compressing space.

$$\therefore \eta_{Att} = -20\log\left(\frac{S_1}{S_2}\right) = -20\log|\sin kL_1| \tag{15}$$

Figure 7:
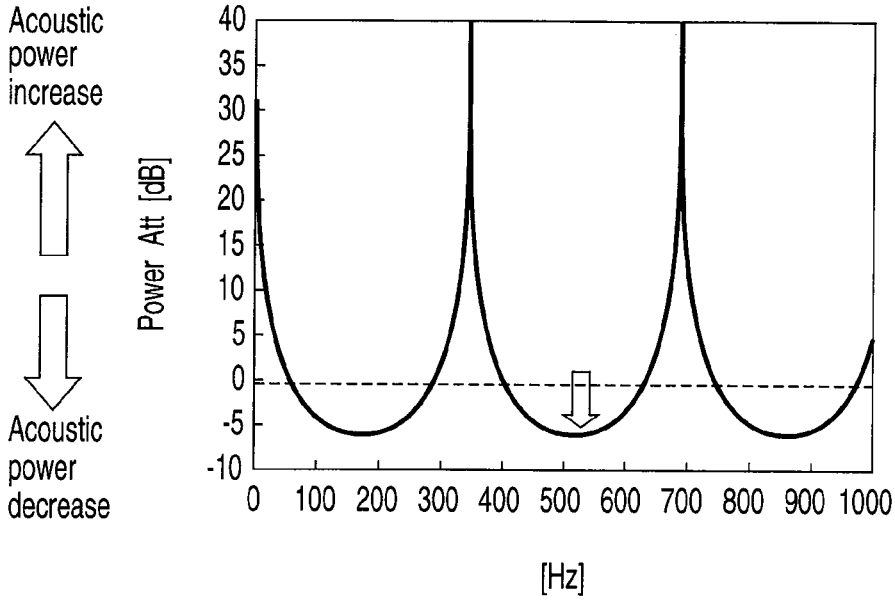
FIG. 7 is a graph showing the results of simulation illustrating the acoustic power propagation through the conveying path shown in FIG. 1.

A decrease in sectional area reduces the acoustic power by 20 log(S1/S2) as shown in FIG. 7. Furthermore, the conveying path length L1 relates to an increase in noise level and the noise level increases at a resonance frequency shown in Formula 16 based on the following formula.

$$kL_1 = n\pi \quad n = 1, 2, \ldots \quad f = \frac{nc}{2L_1}(n = 1, 2, \ldots) \tag{16}$$

$$\because k = \frac{2\pi f}{c} \tag{17}$$

(Sound Velocity c=343 m/s)

Furthermore, no change occurs at a frequency shown in Formula 18.

$$kL_1 = \frac{(2n-1)\pi}{2} \quad n = 1, 2, \ldots \tag{18}$$

$$f = \frac{(2n-1)c}{4L_1}(n = 1, 2, \ldots) \tag{19}$$

These relationships are shown in FIG. 7. An arrow in FIG. 7 corresponds to a decrease in dB unit. On the other hand, the propagation occurs as follows in the bulging space.

$$\therefore \eta_{Att} = -20\log|\cos kL_2| \tag{20}$$

The conveying path length L2 relates to an increase in noise level and increases at a resonance frequency shown in Formula 22.

$$kL_2 = \frac{(2m-1)\pi}{2} \quad m = 1, 2, \ldots \tag{21}$$

$$f = \frac{(2m-1)c}{4L_2}(m = 1, 2, \ldots) \tag{22}$$

Figure 8:
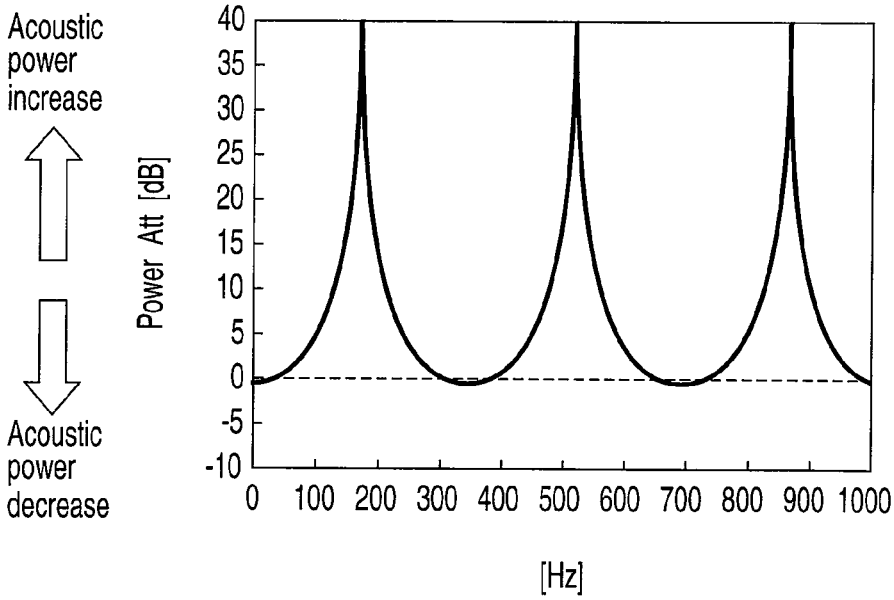
FIG. 8 is a graph showing the results of the simulation illustrating the acoustic power propagation through the conveying path shown in FIG. 1.

These relationships are shown in FIG. 8. Furthermore, no change occurs at a frequency expressed by Formula 24.

$$kL_2 = m\pi \quad m = 1, 2, \ldots \tag{23}$$

$$f = \frac{mc}{2L_2}(m = 1, 2, \ldots) \tag{24}$$

Consequently, if the bulging space and the compressing space are continuously arranged, a sound reduction effect is exerted when a sound wave propagates from the bulging space to the compressing space. A sectional area ratio is effective on the amount of the sound reduction.

However, since the acoustic power increases at the resonance frequency associated with the length L1 of the bulging space, the length L1 of the upstream bulging space also needs to be sufficiently noted in connection with the formation of the compressing space.

On the other hand, when the sound wave propagates from the compressing space to the bulging space, the acoustic power increases at the resonance frequency associated with the length L2 (L1 in the above-described figure) of the compressing space. Thus, the formation of the bulging space downstream of the compressing space is desirably avoided as much as possible. However, in actuality, this is often impossible owing to other restrictions. Therefore, after the noise passes through the path, the noise level may increase.

Thus, according to the embodiments of the present invention, even in this case, the sound reduction effect of the compressing space can be maintained on the basis of the relationship between the lengths L1 and L2 of the two spaces.

First, for the spaces in the conveying path shown in FIG. 6, a bad condition will be described, that is, the case in which the compressing no-change frequency is equal to the bulging resonance frequency. Formula 35 is established on the basis of Formulas 19 and 22.

$$f = \frac{(2n-1)c}{4L_1} = \frac{(2m-1)c}{4L_2} \quad (25)$$

$$(n = 1, 2, \ldots)(m = 1, 2, \ldots)$$

$$\therefore L_2 = \frac{2m-1}{2n-1} L_1$$

Figure 9B:
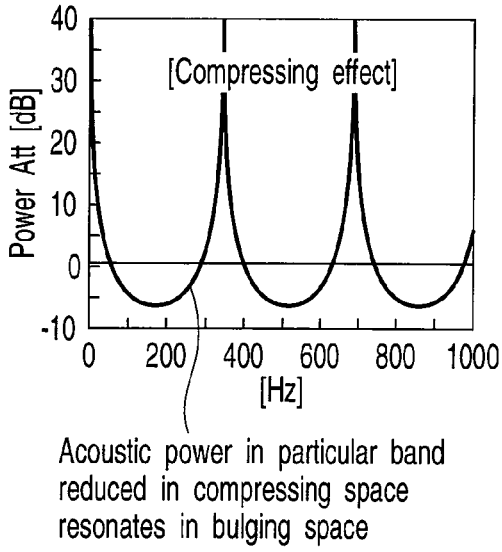
FIGS. 9A to 9C are graphs showing the results of the simulation illustrating the acoustic power propagation through the conveying path shown in FIG. 1.
Figure 9C:
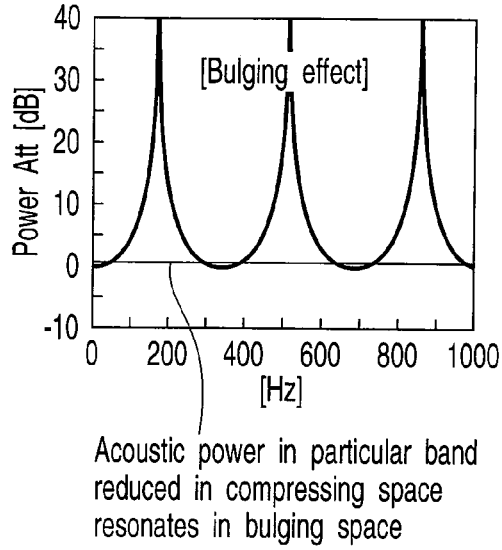
Figure 9A:
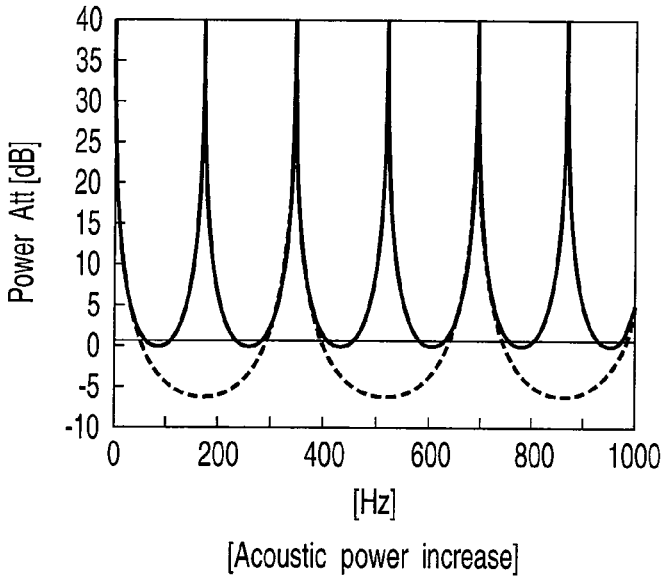

In this case, the result is an increase in acoustic power as shown in FIG. 9A. As is understood from FIGS. 9A to 9C, the relationship shown in FIG. 9A corresponds to the sum of the frequency characteristic in FIG. 9B and the frequency characteristic in FIG. 9C. The acoustic power of a sound in a certain frequency band is reduced under the effect of the compressing space as shown in FIG. 9B. The sound then resonates in the bulging space owing to the frequency characteristic as shown in FIG. 9C; the acoustic power of the sound is thus increased.

In contrast, when the compressing no-change frequency is equal to a bulging no-change frequency, Formula 26 is established on the basis of Formulas 19 and 24.

$$f = \frac{(2n-1)c}{4L_1} = \frac{mc}{2L_2} \quad (26)$$

$$(n = 1, 2, \ldots)(m = 1, 2, \ldots)$$

$$\therefore L_2 = \frac{2m}{2n-1} L_1$$

Figure 10B:
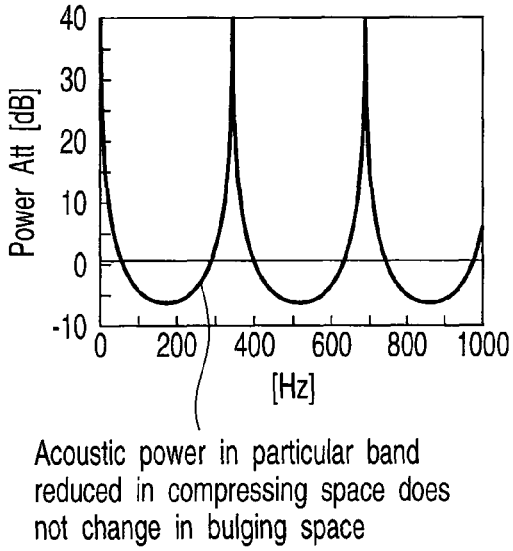
FIGS. 10A to 10C are graphs showing the results of the simulation illustrating the acoustic power propagation through the conveying path shown in FIG. 1.
Figure 10C:
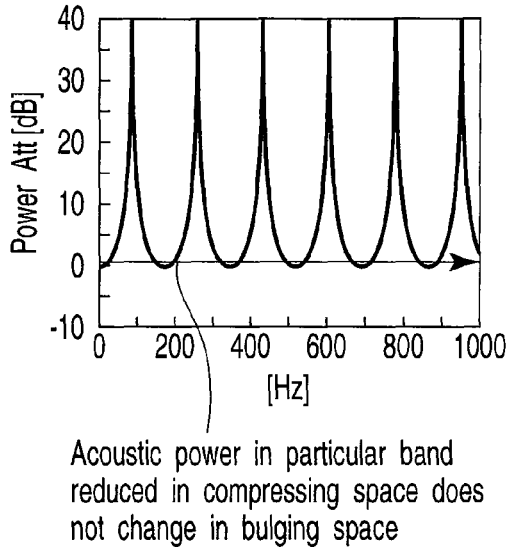

Thus, as shown in FIG. 10B, the frequency at which the acoustic power decreases in the upstream compressing space as shown in FIG. 10B corresponds to a no-change band in the bulging space as shown in FIG. 10C. Thus, the characteristics of the bunging space are prevented from affecting the acoustic power. Consequently, as shown in FIG. 10A, the acoustic power in the particular band having decreased in the compressing space can be maintained till the end.

In other words, the presence of the downstream bulging space for any reason increases the noise level for the reason described above. However, by additionally providing the compressing space upstream of the bulging space under the arrangement condition satisfying Formula 26, an increase in noise level in the bulging space can be prevented. Moreover, the compressing space is effective for finally reducing the level of the noise having passed through the bulging space.

Figure 10A:
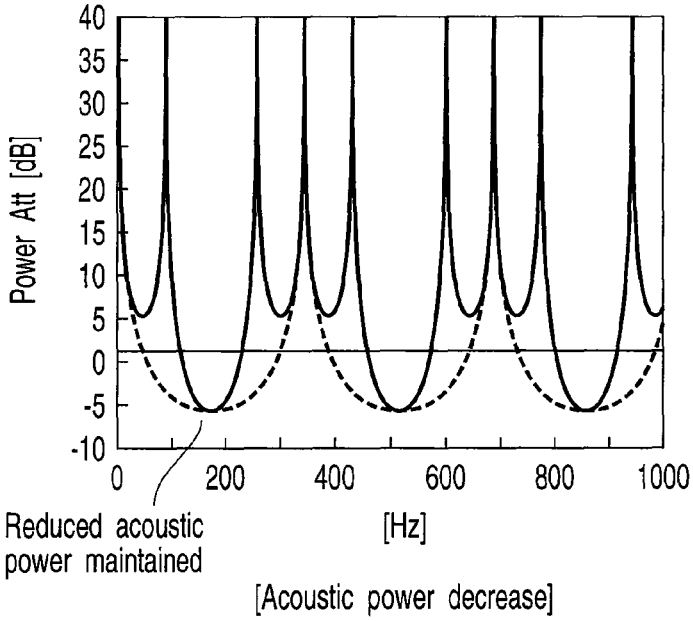
Figure 11A:
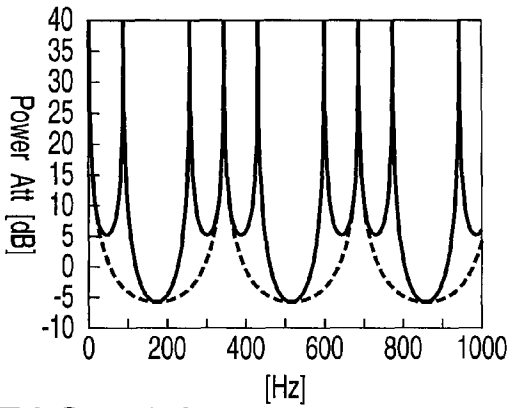
FIGS. 11A to 11F graphs showing the results of the simulation illustrating the acoustic power propagation through the conveying path shown in FIG. 1.
Figure 11B:
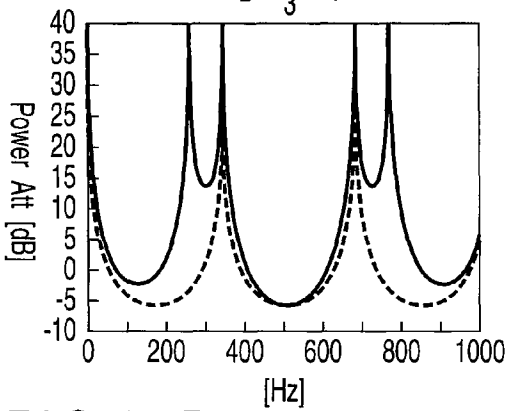
Figure 11C:
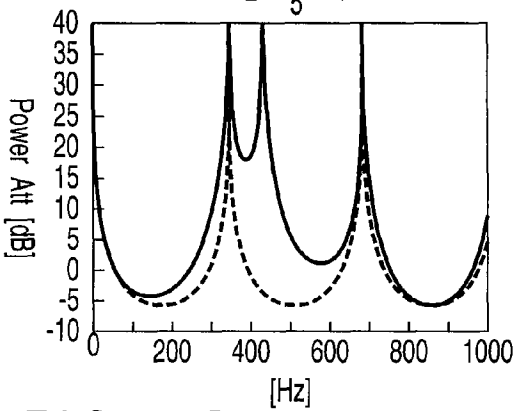
Figure 11D:
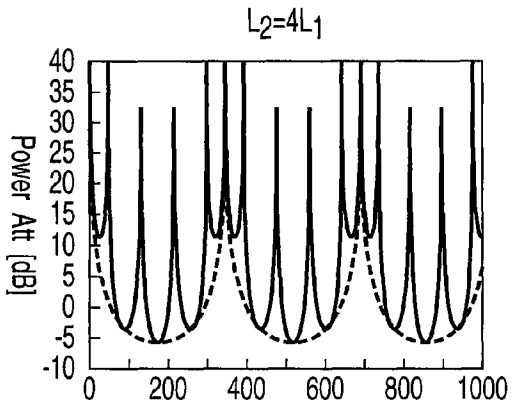
Figure 11E:
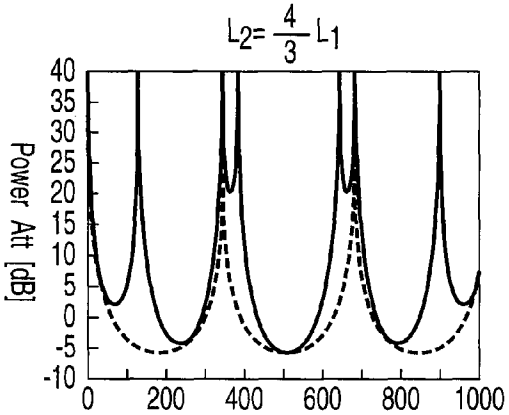
Figure 11F:
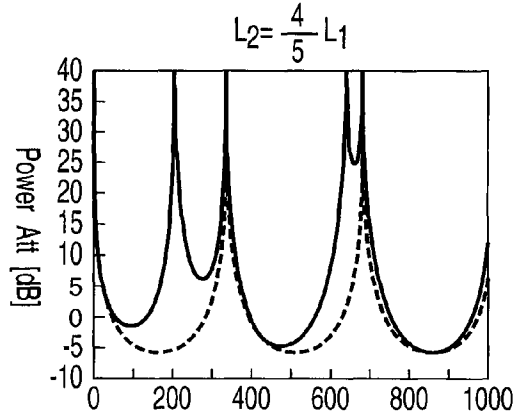

FIG. 10A is only illustrative, and a calculation based on another relationship satisfying Formula 26 results in the relationship shown in FIGS. 11A to 11F. As is understood from the frequency characteristic shown in FIGS. 11A to 11F, at least the acoustic power in the particular frequency band reduced in the compressing space is maintained even after the passage through the bulging space.

Figure 12:
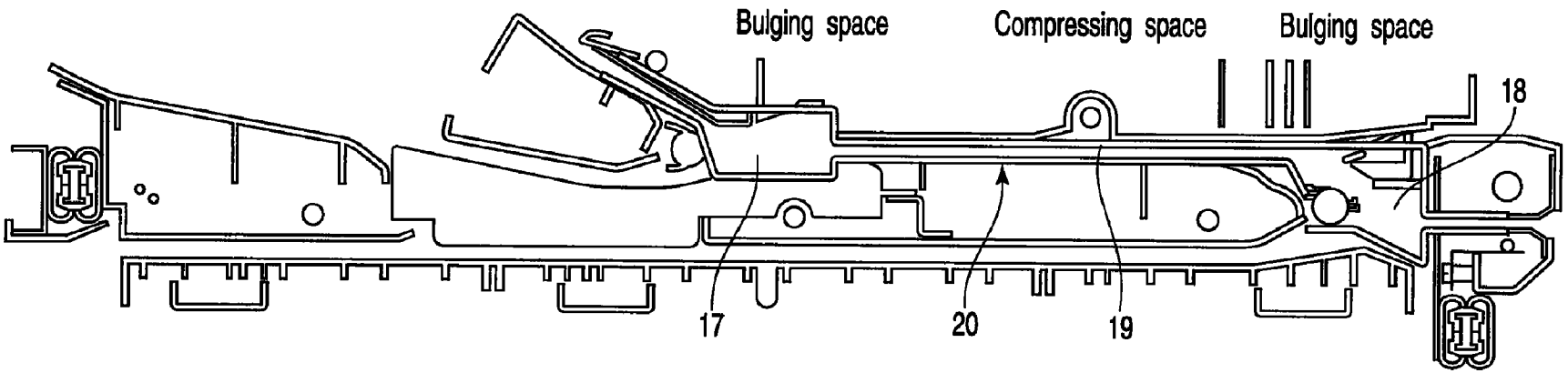
FIG. 12 is a schematic diagram schematically showing a specific example of the sheet conveying apparatus shown in FIG. 1.
Figure 13A:
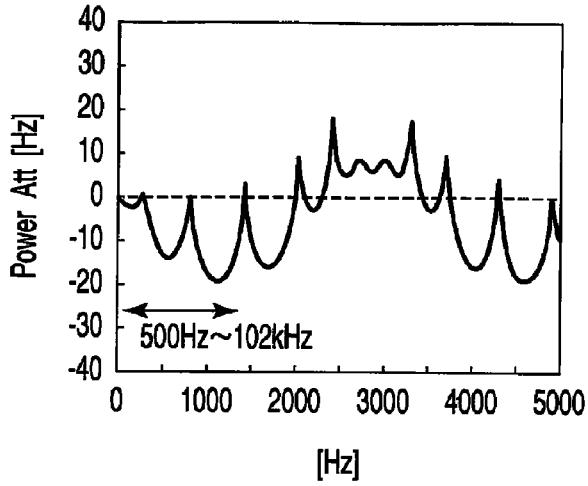
FIG. 13A is a schematic diagram of the sheet conveying apparatus shown in FIG. 12.
Figure 13B:
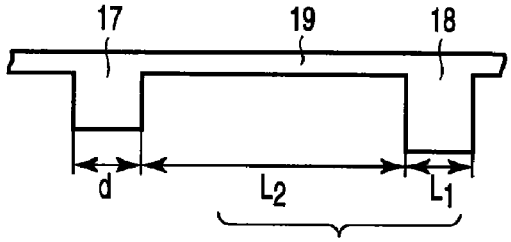
FIG. 13B is a graph showing the results of simulation based on the sheet conveying apparatus shown in FIG. 12.

FIG. 12 shows an example of the structure of an actual conveying path. In the structure shown in FIG. 12, in addition to the bulging space in the left of FIG. 12, a conveying path formed of a bulging space is provided upstream of the bulging space. This enables a reduction in acoustic power in a low frequency region as shown in FIG. 13A. The results in FIG. 13A are obtained on the basis of a conveying path having dimensions d, L2, and L1 shown in FIG. 13B. If optimum conditions are n=1 and m=2 and L2=4L1 as shown in FIG. 13B, the frequency characteristic with respect to acoustic power shown in FIG. 13A is obtained.

SECOND EMBODIMENT

Figure 14A:
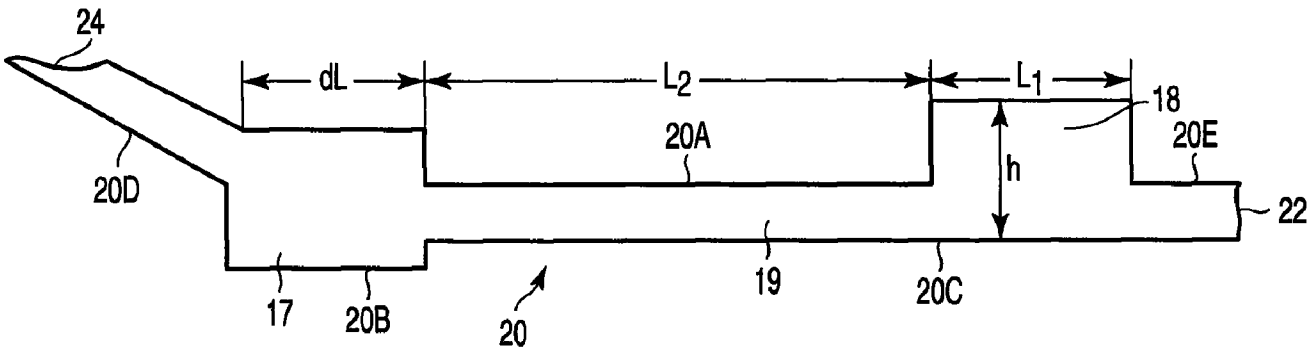
FIGS. 14A to 14C are schematic diagrams showing a variation of the sheet conveying apparatus shown in FIG. 1.
Figure 14B:
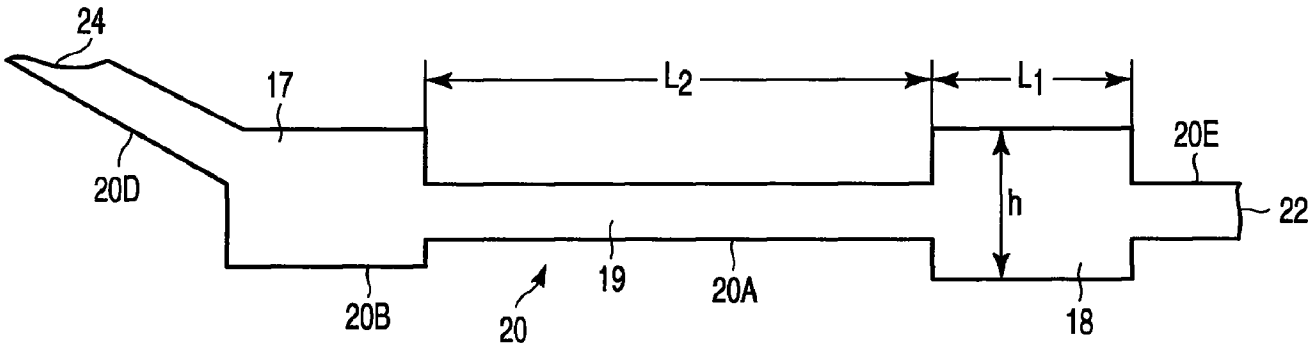
Figure 14C:
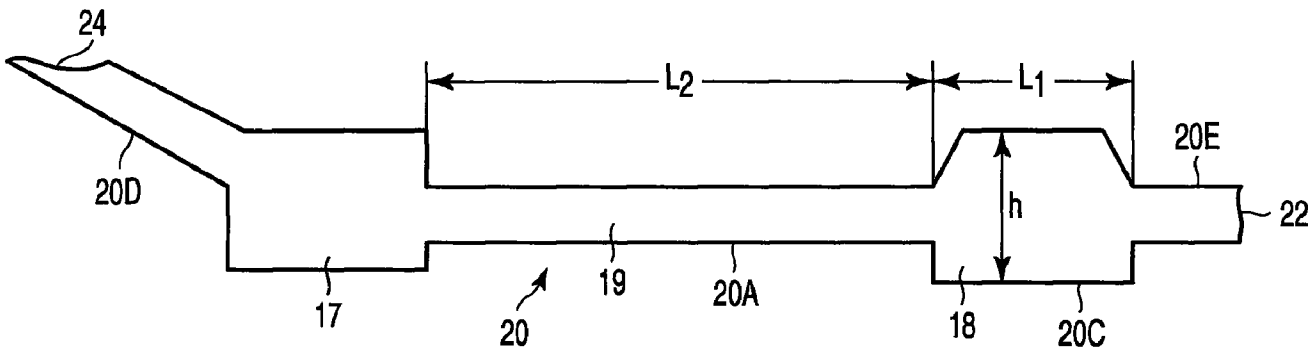

FIGS. 14A to 14C show an image forming apparatus according to a second embodiment of the present invention.

As shown in FIG. 14A, the conveying path 18 having the length L1 along the conveying path is formed in the housing portion 20C having a bottom surface continuous with inner bottom surfaces (sheet passing surfaces) of the rectangular, flat housing portions 20A and 20E. The housing portion 20C may be formed to bulge upward like a protrusion so as to have an opposite surface with a height H larger than that of the housing portions 20A and 20E. Furthermore, as shown in FIG. 14B, the conveying path 18 having the length L1 along the conveying path may be formed to bulge both upward and downward, that is, to protrude both upward and downward so as to have the height h between the inner bottom surface and the opposite surface so that the housing portion 20C has an inner bottom surface and an opposite surface opposite to the inner bottom surface each having a height different from that of the inner bottom surfaces (sheet passing surfaces) of the rectangular, flat housing portions 20A and 20E and opposite surfaces opposite to the inner bottom surfaces. Moreover, as shown in FIG. 14C, the conveying path 18 having the length L1 along the conveying path may be formed to bulge both upward and downward, that is, to protrude both upward and downward so as to have the height h between the inner bottom surface and the opposite surface so that the housing portion 20C has the inner bottom surface and the opposite surface opposite to the inner bottom surface each having a height different from that of the inner bottom surfaces (sheet passing surfaces) of the rectangular, flat housing portions 20A and 20E and opposite surfaces opposite to the inner bottom surfaces and so that the bulging portion of the housing portion 20*c* has a different shape.

In general, at a frequency equal to or lower than that shown in Formula 27 and determined by a diameter d if the conveying path has a circular cross section or a length d if the conveying path has a rectangular cross section, sound propagates one-dimensionally, that is, a sheet conveying direction, through the conveying path as a plane wave.

$$\text{Circle: } f = \frac{1 \cdot 2c}{2d} (\mathrm{H}_2) \quad (27)$$

$$\text{Rectangle: } f = \frac{c}{2d} (\mathrm{H}_2)$$

Figure 15:
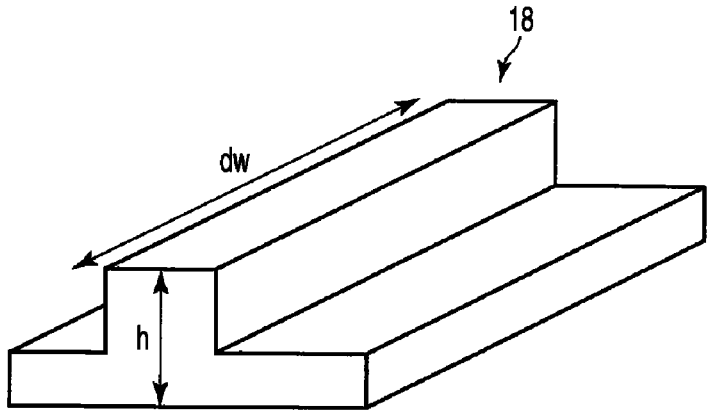
FIG. 15 is a schematic diagram showing dimensions of a bulging space in the sheet conveying apparatus shown in FIG. 1.

Consequently, for example, if the conveying path is a rectangular parallelepiped having an inward length dw and a height h as shown in FIG. 15, provided that the height h is equal to or smaller than dw, propagation occurs even with the different path shape as shown in FIG. 14C.

THIRD EMBODIMENT

Figure 16:
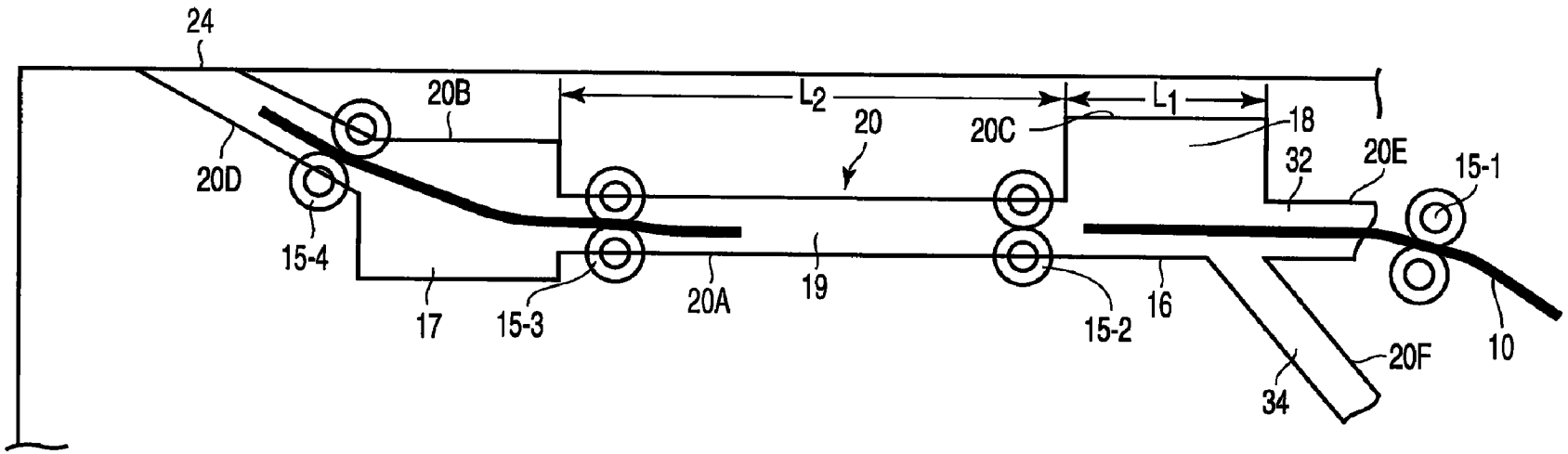
FIG. 16 is a schematic diagram showing a sheet conveying apparatus according to a third embodiment of the present invention.

FIG. 16 shows an image forming apparatus according to a third embodiment of the present invention. As shown in FIG. 16, two conveying paths 32 and 34 may be coupled to the upstream side of the conveying path 18 extending in a protruding bulging space and having the length L1 (conveying direction) so that the conveying path 18 has two sheet entry ports. The two conveying paths 32 and 34 are defined by rectangular, flat housing portions 20E and 20F, respectively.

Even with the two sheet entry ports, sound travels to the conveying path with the length L1 (conveying direction) through each of the ports as is the case with Embodiment 2. Consequently, the acoustic power having entered the conveying path through each of the ports varies as shown in Embodiment 1 while propagating through the conveying path and is finally discharged. Of course, when a sheet enters the conveying path, if two sound waves having opposite phases and a time delay propagate separately through the two sheet entry ports, the sound waves interfere with each other upon entry to reduce the respective acoustic powers. However, in calculations, the same results are obtained regardless of whether the acoustic powers measured upon entry or discharge are simultaneously and collectively calculated.

FOURTH EMBODIMENT

Figure 17:
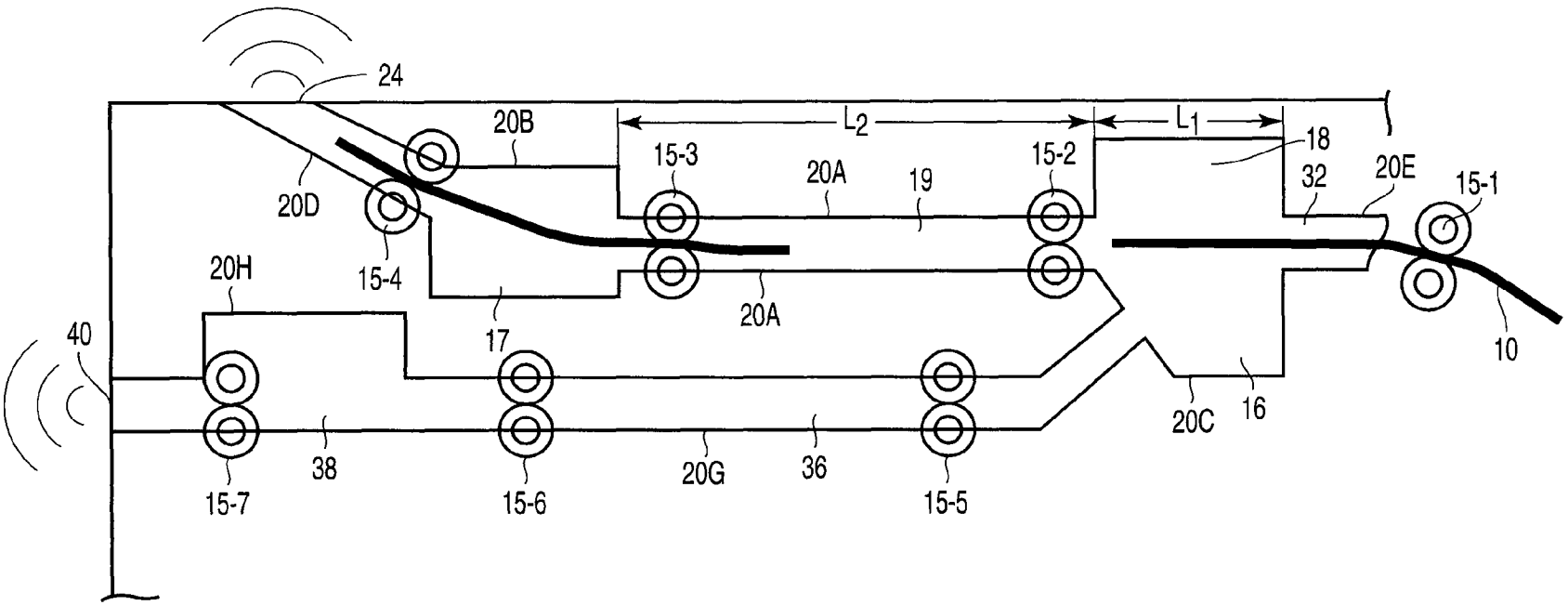
FIG. 17 is a schematic diagram showing a sheet conveying apparatus according to a fourth embodiment of the present invention.

FIG. 17 shows an image forming apparatus according to a fourth embodiment of the present invention.

Two conveying paths 19 and 36 may be coupled to the downstream side of the conveying path 18 extending in a protruding bulging space and having the length L1 (conveying direction) so that the conveying path 18 has two sheet discharging ports. A conveying path switching mechanism (switchback) is provided in the conveying path 18 shown in FIG. 17. The sheet 10 supplied to the conveying path 18 is conveyed toward one of the two sheet discharging ports by the conveying path switching mechanism.

In the apparatus shown in FIG. 17, one of the additional conveying paths, the conveying path 19, is defined by the rectangular, flat housing portion 20A. As in the case of the housing portion 20A, the other additional conveying path 36 is defined by a rectangular, flat housing portion 20G. A bulging housing portion 20H is coupled to the housing portion 20G to provide a conveying path 36 having a bulging space. The conveying path 36 has roller pairs 15-5 and 15-6 as is the case with the conveying path 19. The conveying path 38 also has a roller pair 15-7 on a discharge side so that the sheet 10 is discharged toward a discharge port 40.

Even when the conveying path 18 having the bulging space has the two sheet discharging ports, sound radiated to each of the ports through the conveying path 18 having the length L1 (conveying direction) travels as described in Embodiment 2. The noise is thus similarly attenuated.

As described above, the present invention provides the sheet conveying mechanism that can inexpensively reduce noise generated inside the conveying path during sheet conveyance without hindering the conveyance of the sheet.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A conveying mechanism comprising:

a pair of conveying rollers which conveys a paper-like medium;

a conveying guide which guides the paper-like medium to the conveying rollers; and a conveying housing which defines a conveying path along which the paper-medium is conveyed, a first bulging space and a second bulging space being provided on a downstream side and an upstream side, respectively, of the conveying path, the second bulging space having a length L1 along the conveying path, the conveying path between the first and second bunging spaces being defined to have a length L2, the lengths L1 and L2 satisfying a relationship expressed by Formula 1, $$L_2 = \frac{2m}{2n-1} L_1 \quad (1)$$

$$(n = 1, 2, \ldots)(m = 1, 2, \ldots)$$

$$f = \frac{(2n-1)c}{4L_1} \quad (2)$$

$$(n = 1, 2, \ldots)$$

wherein in Formulas 1 and 2, c denotes sound velocity, and f denotes a frequency of possible noise propagating through the conveying path and corresponds to a central frequency of a frequency band of noise to be attenuated in the conveying housing.

2. The mechanism according to claim 1, wherein the conveying housing includes a first housing portion and a second housing portion which define the first and second bulging spaces, respectively, and the first and second housing portions respectively have an introduction port through which the paper-like medium enters the conveying path and a discharge port through which the paper-like medium is discharged, and the length L1 corresponds to a shortest length joining a center of a cross section of the introduction port of the first housing portion to a center of a cross section of the discharge port of the first housing portion, and the length L2 corresponds to a shortest length joining a center of a cross section of the discharge port of the second housing portion to a center of a cross section of the introduction port of the first housing portion.

3. The mechanism according to claim 1, wherein the conveying housing includes the first housing portion and the second housing portion which define the first and second bulging spaces, respectively, and a third housing portion which couples the first and second housing portions together, the first, second, and third housing portions have a common medium passing surface, and the first housing portion forms a space which bulges between the common medium passing surface and an opposite surface opposite to the medium passing surface.

4. The mechanism according to claim 1, wherein the conveying housing includes the first housing portion and the second housing portion which define the first and second bulging spaces, respectively, and the third housing portion which couples the first and second housing portions together, the third housing portion has a medium passing surface, and the first housing portion forms a space which bulges between a pair of an opposite surfaces each having a height different from that of the medium passing surface.

5. The mechanism according to claim 1, wherein the conveying housing includes the first housing portion and the second housing portion which define the first and second bulging spaces, respectively, and the third housing portion which couples the first and second housing portions together, and the first housing portion has two entry ports on an upstream side to which respective conveying paths are coupled.

6. The mechanism according to claim 1, wherein the conveying housing includes the first housing portion and the second housing portion which define the first and second bulging spaces, respectively, the third housing portion which couples the first and second housing portions together, a fourth housing portion which defines a third bulging space, and a fifth housing portion which couples the first and fourth housing portions together, and the first housing portion has two discharging ports on a downstream side to which two conveying paths defined in the third and fifth housing portions, respectively, are coupled.

7. An apparatus for conveying a sheet comprising:

a conveying housing which defines a conveying path along which the sheet is conveyed, a first bulging space and a second bulging space being provided on a downstream side and an upstream side, respectively, of the conveying path, the second bulging space having a length L1 along the conveying path, the conveying path between the first and second bunging spaces being defined to have a length L2, the lengths L1 and L2 satisfying a relationship expressed by Formula 1, $$L_2 = \frac{2m}{2n-1} L_1 \quad (1)$$

$$(n = 1, 2, \ldots)(m = 1, 2, \ldots)$$

$$f = \frac{(2n-1)c}{4L_1} \quad (2)$$

$$(n = 1, 2, \ldots)$$

wherein in Formulas 1 and 2, c denotes sound velocity, and f denotes a frequency of possible noise propagating through the conveying path and corresponds to a central frequency of a frequency band of noise to be attenuated in the conveying housing.

8. The apparatus according to claim 7, wherein the conveying housing includes a first housing portion and a second housing portion which define the first and second bulging spaces, respectively, and the first and second housing portions respectively have an introduction port through which the sheet enters the conveying path and a discharge port through which the sheet is discharged, and the length L1 corresponds to a shortest length joining a center of a cross section of the introduction port of the first housing portion to a center of a cross section of the discharge port of the first housing portion, and the length L2 corresponds to a shortest length joining a center of a cross section of the discharge port of the second housing portion to a center of a cross section of the introduction port of the first housing portion.

9. The apparatus according to claim 7, wherein the conveying housing includes the first housing portion and the second housing portion which define the first and second bulging spaces, respectively, and a third housing portion which couples the first and second housing portions together, the first, second, and third housing portions have a common sheet passing surface, and the first housing portion forms a space which bulges between the common sheet passing surface and an opposite surface opposite to the sheet passing surface.

10. The apparatus according to claim 7, wherein the conveying housing includes the first housing portion and the second housing portion which define the first and second bulging spaces, respectively, and the third housing portion which couples the first and second housing portions together, the third housing portion has a sheet passing surface, and the first housing portion forms a space which bulges between a pair of an opposite surfaces each having a height different from that of the sheet passing surface.

11. The apparatus according to claim 7, wherein the conveying housing includes the first housing portion and the second housing portion which define the first and second bulging spaces, respectively, and the third housing portion which couples the first and second housing portions together, and the first housing portion has two entry ports on an upstream side to which respective conveying paths are coupled.

12. The apparatus according to claim 7, wherein the conveying housing includes the first housing portion and the second housing portion which define the first and second bulging spaces, respectively, the third housing portion which couples the first and second housing portions together, a fourth housing portion which defines a third bulging space, and a fifth housing portion which couples the first and fourth housing portions together, and the first housing portion has two discharging ports on a downstream side to which two conveying paths defined in the third and fifth housing portions, respectively, are coupled.

* * * * *